US005272862A

United States Patent [19]

Stahlecker et al.

[11] Patent Number: 5,272,862

[45] **Date of Patent: * Dec. 28, 1993**

[54] SPINNING MACHINE WITH A YARN PIECING MOBILE SERVICING CARRIAGE HAVING A TEMPORARY YARN STORAGE CAPACITY

[75] Inventors: Fritz Stahlecker, Josef-Neidhart-Strasse 18, 7347 Bad Überkingen; Josef Scholz, Bad Ditzenbach, both of Fed. Rep. of Germany

[73] Assignees: Fritz Stahlecker; Hans Stahlecker, Fed. Rep. of Germany

[ * ] Notice: The portion of the term of this patent subsequent to Mar. 23, 2010 has been disclaimed.

[21] Appl. No.: 748,517

[22] Filed: Aug. 22, 1991

[30] Foreign Application Priority Data

Aug. 29, 1990 [DE] Fed. Rep. of Germany ..... 4027210

[51] Int. Cl.[5] ..... B65H 49/26; B65H 54/00

[52] U.S. Cl. ..... 57/22; 242/35.6 R; 242/42

[58] Field of Search ..... 57/22, 261, 263, 264, 57/328; 242/35.6 R, 42

[56] References Cited

U.S. PATENT DOCUMENTS 4,535,944 8/1985 Nakahara et al. ..... 57/263 X
4,947,633 8/1990 Stahlecker ..... 57/261 X
4,958,486 9/1990 Stahlecker ..... 57/261
4,972,668 11/1990 Stahlecker ..... 57/261
5,079,908 1/1992 Stahlecker ..... 57/264 X
5,142,856 9/1992 Nakayama et al. ..... 57/264 X

FOREIGN PATENT DOCUMENTS 0277717 8/1988 European Pat. Off. .
3824850 9/1989 Fed. Rep. of Germany .
3817222 11/1989 Fed. Rep. of Germany .

*Primary Examiner*—Daniel P. Stodola
*Assistant Examiner*—Michael R. Mansen
*Attorney, Agent, or Firm*—Evenson, McKeown, Edwards & Lenahan

[57] ABSTRACT

In the case of a spinning machine having a plurality of spinning units and a movable arrangement for eliminating a yarn breakage which comprises devices for storing the newly spun yarn during the establishment of a yarn connection, it is provided that the devices for the storing of the yarn comprise a sensor which determines a predetermined point in time of the emptying. The sensor is connected to a control device and the signal of which determines the starting point in time of a time period given in the control device during which the drive of the auxiliary winding device still continues to run at an increased winding speed as compared to normal spinning operations.

26 Claims, 7 Drawing Sheets

SPINNING MACHINE WITH A YARN PIECING MOBILE SERVICING CARRIAGE HAVING A TEMPORARY YARN STORAGE CAPACITY

BACKGROUND AND SUMMARY OF THE INVENTION

The invention relates to a spinning machine having a plurality of spinning units arranged in at least one row next to one another which each comprise devices for spinning a yarn and devices for winding up this yarn into a wound-up package. A movable arrangement for eliminating a yarn breakage is provided which can be applied to the individual spinning units and which comprises devices for the temporary taking-over of a newly spun yarn, devices for taking the broken yarn from the wound-up package, devices for connecting the newly spun yarn and the yarn taken off the wound-up package, devices for winding the connected yarn onto the wound-up package and devices for returning the wound-up package and the travelling yarn to the respective spinning unit. Devices belonging to the movable arrangement have a drive for winding up the yarn, this drive, while the devices for the storing of the yarn are emptied, being drivable at an increased winding speed.

In the case of a spinning machine of this type, as it is known on the basis of the German Patent Document DE-A 38 17 222, the yarn length deposited in the devices for storing the yarn can be determined relatively precisely because of the time which is required for establishing the yarn connection and during which the winding-up of the yarn does not take place. In contrast, it is very difficult to determine when the stored yarn length will be used up, that is, when the devices for the storing of the yarn are completely empty and the travelling yarn and the wound-up package may be returned to the spinning unit. Because of different parameters, a very different slippage may occur between the wound-up package and the devices for the winding-up so that it is not precisely determined which yarn length is wound up during which time and withdrawn from the devices for the storing. This may result in an overstraining of the yarn and imprecisions in the winding-up. This is true particularly since also before the yarn transfer to the spinning unit and the transfer of the wound-up package to the spinning unit, the excess yarn length should have been used up which was the result of the fact that the yarn, during the yarn connecting, is guided through the arrangement for eliminating a yarn breakage and in the process forms a so-called "yarn knee".

It is also known (German Patent Document DE-A 38 24 850) to equip each spinning unit with a yarn storage device in the form of a suction tube which is arranged between a pair of delivery rollers of the spinning unit and the area into which a splicing device of the movable arrangement is brought. The movable arrangement does not comprise any separate devices for the winding-up of the yarn after the establishment of the yarn connection. The yarn length stored in the stationary storage device must therefore, after the establishment of the spliced connection, be used up by a difference between the delivery speed at which the yarn is spun, and the wind-up speed at which the yarn is wound up during the normal operation.

It is also known (European Patent Document EP-A 0 277 717) to assign to each spinning unit a stationary yarn storage device which is operative during the normal spinning operation. In this construction, the yarn storage device is equipped with sensors which detect the loop size of the yarn disposed in the yarn storage device and which control the winding speed as a function of it.

In an older German Patent Application P 39 05 940.5 of the applicants corresponding in part to U.S. Pat. No. 5,079,908, which is no prior publication, a spinning machine of the initially mentioned type is described in which, additionally, a sensor is assigned to the devices for the storage of the yarn by means of which the point in time of the emptying can be determined. As a function of this determination, the winding speed of the devices of the movable arrangement for the winding-up is controlled.

It is an object of the invention to develop a spinning machine of the initially mentioned type such that, during and mainly after the establishment of a yarn connection, a controlled yarn travel is ensured at any time until the travelling yarn and the wound-up package have been returned to the spinning unit.

This object is achieved according to preferred embodiments of the invention in that a sensor which determines the point in time of the emptying is assigned to the devices for the storing of the yarn, this sensor being connected to a control device and the signal of which determines the starting point in time of a time period indicated in the control unit, during which the drive of the devices for the winding-up, which are part of the movable arrangement, still continues to run at an increased winding speed.

By means of this construction, it is possible to very precisely determine the yarn length wound up during the increased winding speed and to adapt it to the excess length to be used up. This excess length to be used up is composed of the yarn length deposited in the devices for storing the yarn and of the excess length obtained as a result of the deflection of the yarn travel in the arrangement in comparison to the yarn travel in the spinning unit Imprecisions during the emptying of the devices for the storage which occur particularly during the acceleration to the high wind speed, are eliminated completely. It will then be possible to completely or with a given part use up the excess length of the so-called "yarn knee".

In a further development of the invention, it is provided that the control device contains a control program which accelerates the drive of the devices for the winding up which belong to the movable arrangement, after the establishment of the yarn connection, first to a winding speed which amounts to approximately twice the winding speed of a spinning unit, and then reduces it to a lower winding speed which, however, is still above the winding speed of the spinning unit before the devices for the storing of the yarn have been emptied. As a result, it is achieved that, during the determined time period which is needed for the complete or partial using-up of the excess length caused by the "yarn knee", no major decelerations of the winding roller must take place which, under certain circumstances, may be connected with slippage phenomena and may therefore be the cause of inaccuracies.

In a further development of the invention, it is provided that the control program reduces the winding speed to an at least approximately constant value. As a result, it is possible to simplify the control device by the fact that only a time period is determined which is required for the complete or partial using-up of the excess length caused by the "yarn knee". The signal of the sensor, which may occur at different points in time, will take place when essentially the same winding speeds exist so that the time period for the continuation of the travelling at this increased winding speed may essentially be kept constant.

Other objects, advantages and novel features of the present invention will become apparent from the following detailed description of the invention when considered in conjunction with the accompanying drawings.

DETAILED DESCRIPTION OF THE DRAWINGS

Figure 1:
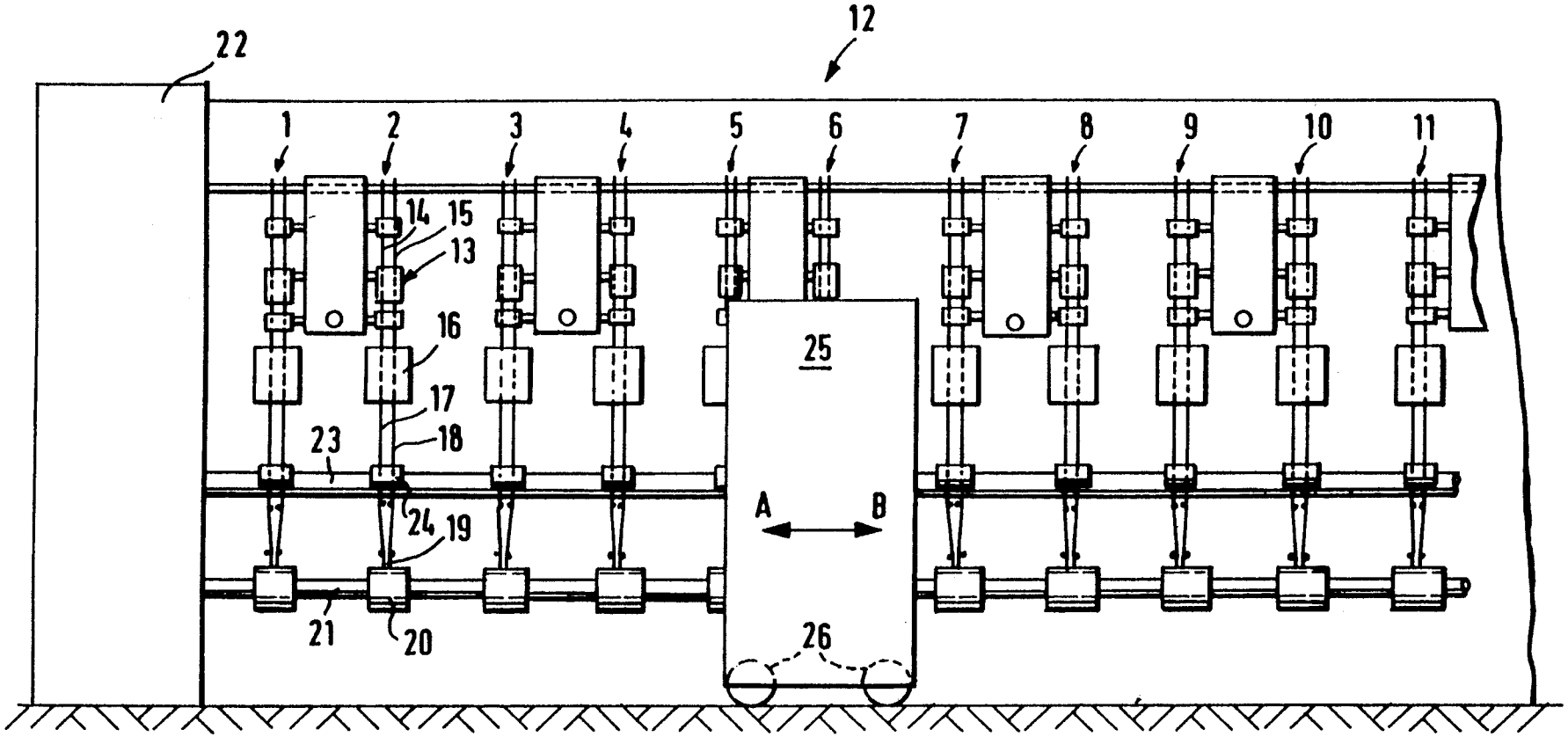
FIG. 1 is a partial front view of a schematically shown spinning machine which has a plurality of spinning units and a movable arrangement for eliminating yarn breakages, constructed according to a preferred embodiment of the present invention.

The spinning machine 12, which is only partially shown in FIG. 1, comprises a plurality of spinning units 1 to 11 which are arranged in a row next to one another. At each front end of the spinning machine 12, a headstock 22 is situated in which drives and transmissions as well as controls and ventilators are housed. Each spinning unit 1 to 11 is constructed as a double spinning unit which each has a drafting unit 13 in which two slivers 14, 15 are drafted which travel in parallel to one another and which subsequently enter into a double nozzle unit 16 with separate yarn ducts. In this double nozzle unit 16, the drafted slivers 14, 15 are pneumatically false-twisted and spun into yarns 17, 18 which in the present case are preferably spun only into prestrengthened yarns 17, 18. The double nozzle units 16 are followed by a withdrawal device which is formed of a driven shaft 23 extending through in the longitudinal direction of the machine, a pressure roller 24 being assigned to the shaft 23 at each spinning unit 1 to 11. The two yarns 17, 18 are subsequently guided together to form a double yarn 19 and are wound onto a wound-up package 20 side-by-side. The wound-up package is driven by a driven winding shaft 21 extending through in the longitudinal direction of the machine.

The spinning machine 12 also comprises an arrangement 25 for the elimination of yarn breakages which patrols on a track by means of an undercarriage comprising running wheels 26 in the direction of the double arrow (A-B) in front of the spinning machine 12 and which, as required, stops at one of the spinning units 1 to 11 and carries out the eliminating of a yarn breakage there.

Figure 2:
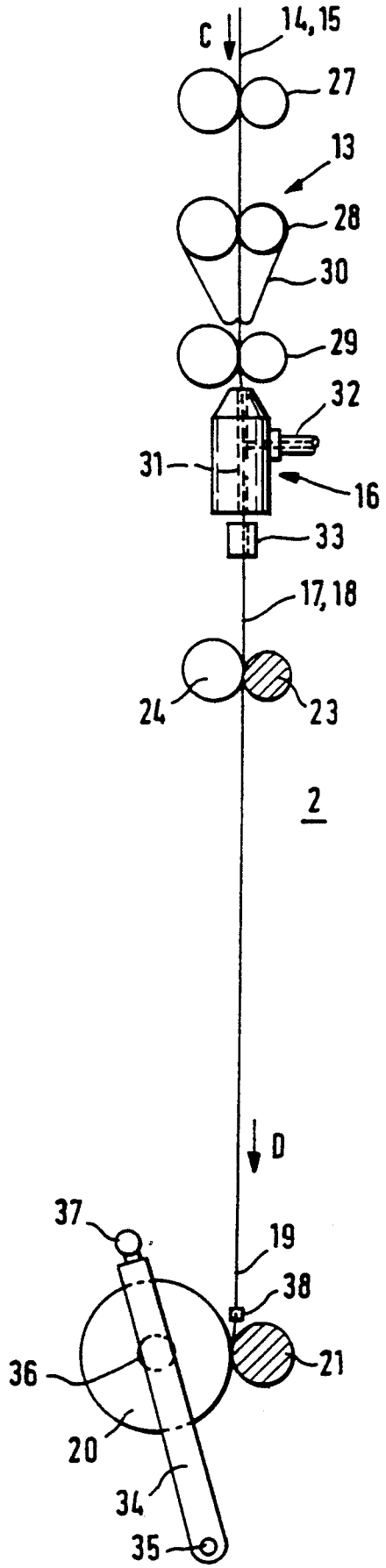
FIG. 2 is an enlarged lateral view of an individual spinning unit of the machine of FIG. 1.

Also in FIG. 2, an individual spinning unit, for example spinning unit 2 is shown only schematically. It comprises the drafting unit 13 through which the slivers 14, 15 travel in the direction of the arrow (C) and in the process are drafted to the desired yarn size. The drafting unit 13 is shown as a three-cylinder drafting unit with three successive roller pairs 27, 28 and 29, an apron guide 30 being provided in the main drafting zone. Naturally, the drafting unit 13 may also be constructed as a multi-cylinder drafting unit, particularly a five-cylinder drafting unit.

The double nozzle unit 16 comprises two yarn ducts 31 into which at least one blow nozzle leads which is directed tangentially to the yarn duct 31, a compressed-air line 32 being connected to the blow nozzle. As a result, yarns 17, 18 are spun in a known manner by pneumatic false-twisting which have their final yarn strength or which possibly may only be prestrengthened and are used as feeds for a subsequent twisting operation.

The double nozzle unit 16 is followed by a yarn detector 33 for each spun yarn 17, 18, the yarn detector stopping the corresponding spinning unit by means of a control device which is not shown when a yarn 17, 18 breaks.

The yarns 17, 18 withdrawn by the withdrawal device 23, 24 are guided to the wound-up package 20 in the direction of the arrow (D), while being combined to a double yarn 19 in a manner not shown in detail. In this area, additional devices are arranged which are not shown, particularly tension regulating devices which are necessary for the cross-winding movement for achieving the cross-wound package shape of the wound-up package 20. A cross-winding yarn guide 38 of this cross-winding device is outlined only schematically. The wound-up package 20, which is wound onto a spool tube 36, is held in a spool frame 34 by means of this spool tube 36 which frame 34 can be swivelled about a shaft 35. On at least one of its arms, the spool frame 34 is equipped with a gripping element 37 to which an actuating mechanism is applied which will be described below and by means of which the spool frame 34, together with the wound-up package 20, can be swivelled away from the winding shaft 21.

Figure 3:
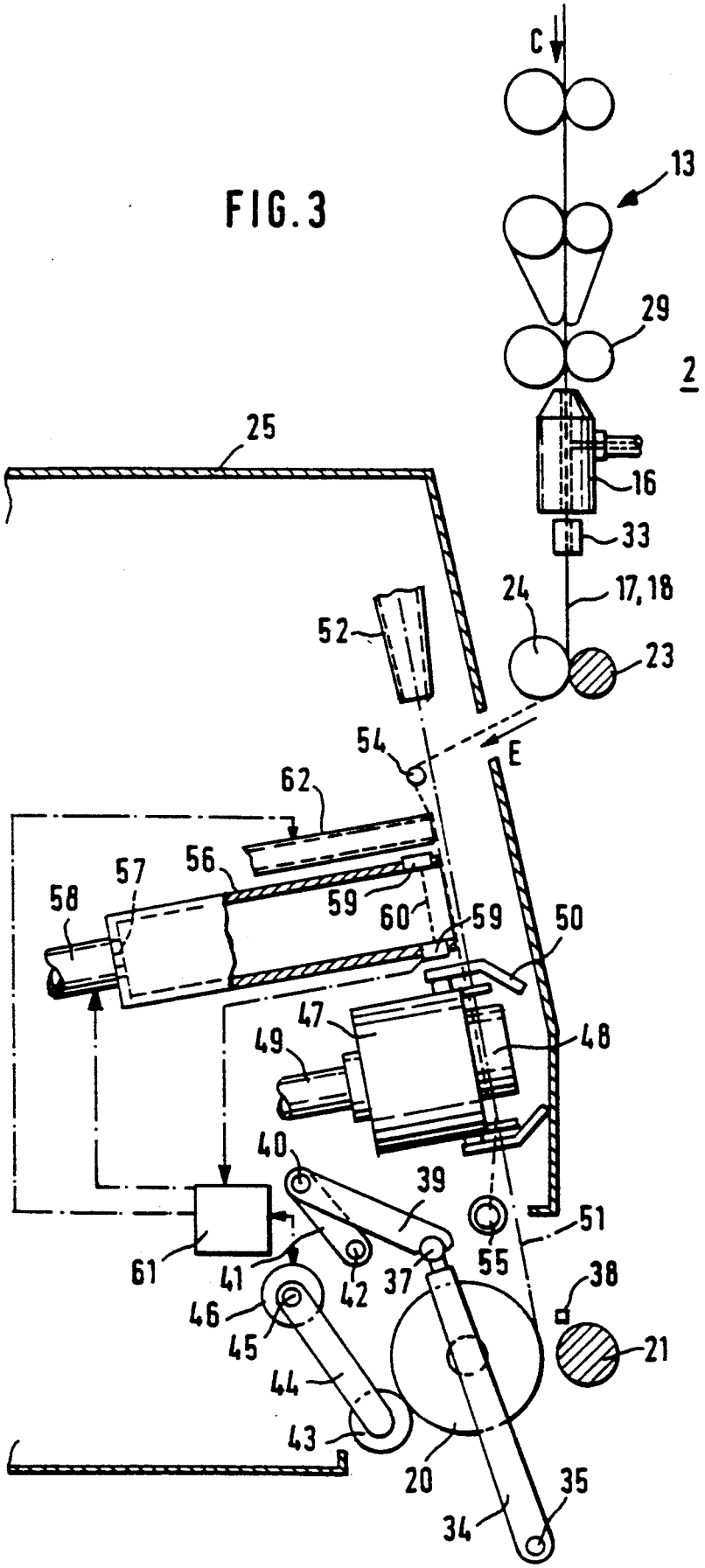
FIG. 3 is a spinning unit according to FIG. 2 and an arrangement for eliminating a yarn breakage during the carrying-out of a splicing operation.

In the case of a yarn breakage, which is detected by one of the yarn detectors 33 the feeding of the slivers 14, 15 is switched off. If necessary, it is also provided that the spool frame 34, by means of a mechanism of the corresponding spinning unit, is swivelled in such a manner that the wound-up package 20 is lifted off the winding shaft 21. In order to eliminate the yarn breakage, a yarn connection between the newly spun yarns 17, 18 and a yarn end taken off the wound-up package 20 is established by means of arrangement 25. This operation is depicted in FIG. 3 only schematically. The arrangement 25 has a lever mechanism which is formed of two levers 39, 41 connected with one another by way of a hinge shaft 40. This lever mechanism can be moved about a shaft 42 by means of driving elements which are not shown, so that lever 39, with its free end, grips the 10 gripping element of the spool frame 37 and swivels it away into a servicing position, that is, away from the winding shaft 21 or farther away from the winding shaft 21.

The arrangement 25 comprises an auxiliary winding roller 43 which is arranged on an arm 44 which can be swivelled about a shaft 45 by means of an actuating drive, which is not shown, in such a manner that the auxiliary winding roller 43 can be applied to the circumference of the wound-up package 20. A driving motor 46 is assigned to the auxiliary winding roller 43 and, by way of a transmission device arranged in the lever arm 44, is connected with the auxiliary winding roller 43. The driving motor 46 can be driven in both rotating directions. The driving motor 46 is controlled by means of a control device 61 which also, in a manner not shown in detail, drives the application drives for the lever mechanism 39, 41 as well as for the swivel lever 44.

The arrangement 25 also comprises a splicing arrangement 47 which has a splicing chamber 48, which is only outlined, and a compressed-air feeding line 49. Yarn guides as well as clamping and cutting devices, which are indicated by reference number 50, are assigned to the splicing arrangement 47 in a known manner.

During the elimination of a yarn breakage, a suction gripper 52 is first applied to the wound-up package 20. The auxiliary winding roller 43 drives the wound-up package 20 in the wind-off direction. The found yarn end 51 (of the double yarn) is picked up by the suction gripper 52 which moves away from the wound-up package 20 and places the yarn end 51 in the splicing chamber 48 of the splicing arrangement 47. Then the auxiliary winding roller 43 is stopped again.

The arrangement 25 is equipped with devices which are not shown and by means of which, in a known manner, the operation of the drafting unit 13 and of the double nozzle unit 16 is switched on again so that newly spun yarns 17, 18 emerge from the double nozzle unit 16. These are taken up by a second suction gripper 55 of the arrangement 25 at the double nozzle unit 16, are placed into the withdrawal device 23, 24, are guided around a yarn guide 54 of the arrangement 25, and are also introduced into the splicing chamber 4 of the splicing arrangement 47. The yarns 17, 18, which travel in the direction of the arrow (E), during this time period, are sucked off by the suction gripper 55 and conveyed to a waste conveyor or container.

In the yarn travel path between the yarn guide 54 and the splicing arrangement 47, a yarn storage device 56 of the arrangement 25 is disposed which has a tube-shaped design with an air-permeable bottom 57 to which a vacuum line is connected by way of a valve which is not shown which can be controlled by the control device 61. In the area of the inlet of the yarn storage device 56, sensors 59 are arranged which form a light barrier 60. The sensors 59 are connected to the control device 61. The sensors 59, arranged at the entrance of storage 56, create a light beam which detects the presence or absence of the yarn loop. Therefore, they directly monitor the point of time at which the yarn loop leaves the storage 56, i.e., leaves the light beam between sensors 59. At that point of time, the remaining yarn length is always the same, i.e., the yarn length extending from the storage to the package. Therefore, any slippage in driving the package automatically is taken into account.

Figure 4:
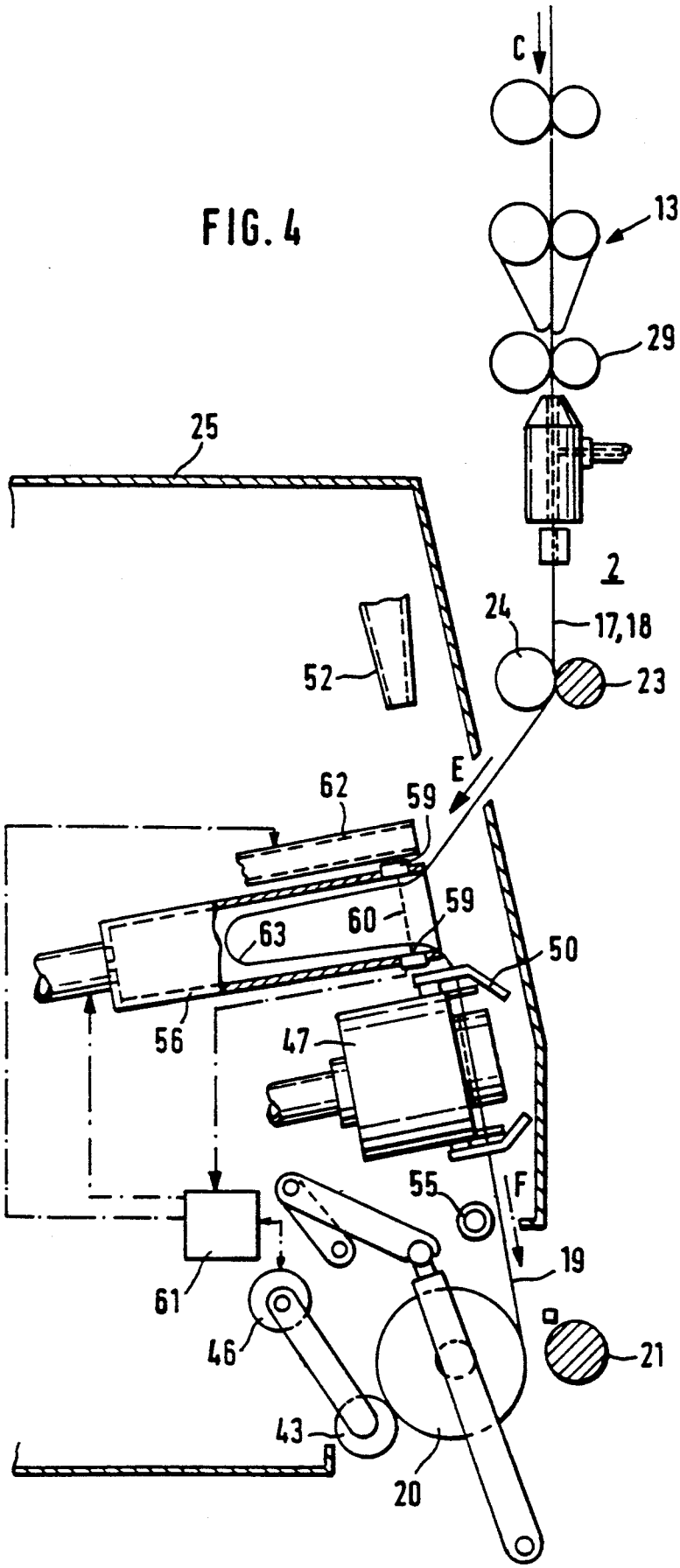
FIG. 4 is a view of the spinning unit according to FIG. 2 and the arrangement for eliminating the yarn breakage after the carrying-out of the splicing operation during the rewinding of the spliced yarn and the emptying of a yarn storage device.

In a known manner, for example, by means of a cam control, the control device 61 also controls the start of the operation of the splicing device 47. During this splicing operation, that is, while the actual splicing woof is carried out and during a possibly preceding preparation of the yarn ends to be spliced, the double yarn formed from the yarns 17, 18 is held in the area of the splicing arrangement by means of a yarn clamp arranged on the side of the splicing chamber 48 facing the yarn storage device 56. The yarns 17, 18, which continue to be produced during this time period, are intermediately stored in the yarn storage device 56 during this time (FIG. 4) which is indicated by the loop 63. After the spliced connection has been established, during which the excessive yarn ends were cut off and sucked off by the suction grippers 52, 55, the control device 61, by way of the auxiliary winding roller 43, will restart the winding-up of the double yarn 19 in the direction of the arrow (F). In this case, the control device 61 controls the driving motor 46 by means of a given control program so that, during the winding-up of the double yarn onto the wound-up package 20, a specific course of the winding speed exists for the emptying of the yarn storage device 56. This may take place, for example, by means of a frequency transformer which controls the driving motor 46, which is constructed as a synchronous motor, according to a specific control program.

Figure 5:
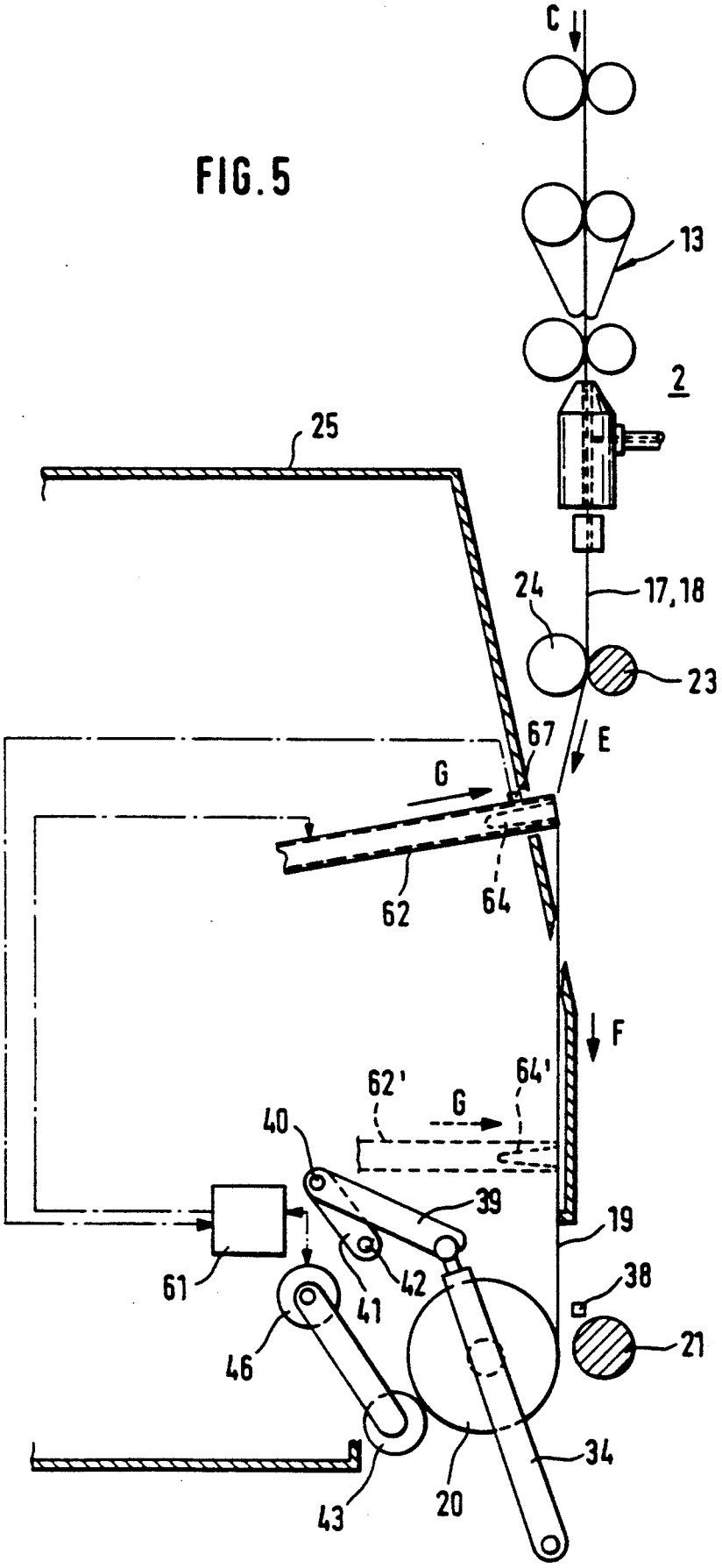
FIG. 5 is a view of the spinning unit according to FIG. 2 and of the arrangement for eliminating the yarn breakage during the return of the travelling yarn to the spinning unit.

After the emptying of the yarn storage device 56, the excess yarn length must also be used up in a controlled manner. This excess yarn length is created by the fact that the yarns 17, 18 and the double yarn 19 were guided through the arrangement 25 during the establishment of the yarn connection which requires a path which is longer than the normal yarn travelling path of the corresponding spinning unit. This returning of the travelling yarn takes place by means of a yarn guide 62 which is also controlled by the control device 61 and which, in the shown embodiment, is constructed as an auxiliary yarn storage device; that is, as a suction tube which is connected with a vacuum source by way of a valve which is not shown and is controlled by the control device 61. This yarn guide 62, with the travelling yarn 19, can be applied to the yarn travelling path of the spinning unit 2 in the direction of the arrow (G) (FIG. 5). In this case, the suction tube 62 picks up the travelling double yarn 19 with a small loop 64 which is opened up by the further driving of the wound-up package 20 at an increased speed. After the opening-up of this loop 64, the winding speed of the wound-up package 20 is reduced to the winding speed of the spinning unit, that is the circumferential speed of the winding shaft 21. Then the spool frame 34 is moved back into its operative position so that the wound-up package 20 rests again on the winding shaft 21. During this transfer, the auxiliary winding roller 43 can move along in this direction and withdraw only subsequently from the wound-up package 20.

As shown by an interrupted line in FIG. 5, the yarn guide 62' constructed as a suction tube may also be arranged behind the splicing arrangement 47; that is, in the area just in front of the wound-up package 20. In this case, it is expedient for the yarn guide 62' constructed as a suction tube to have a width transversely with respect to the yarn travelling direction which corresponds at least approximately to the width of the wound-up package 20.

Figure 6:
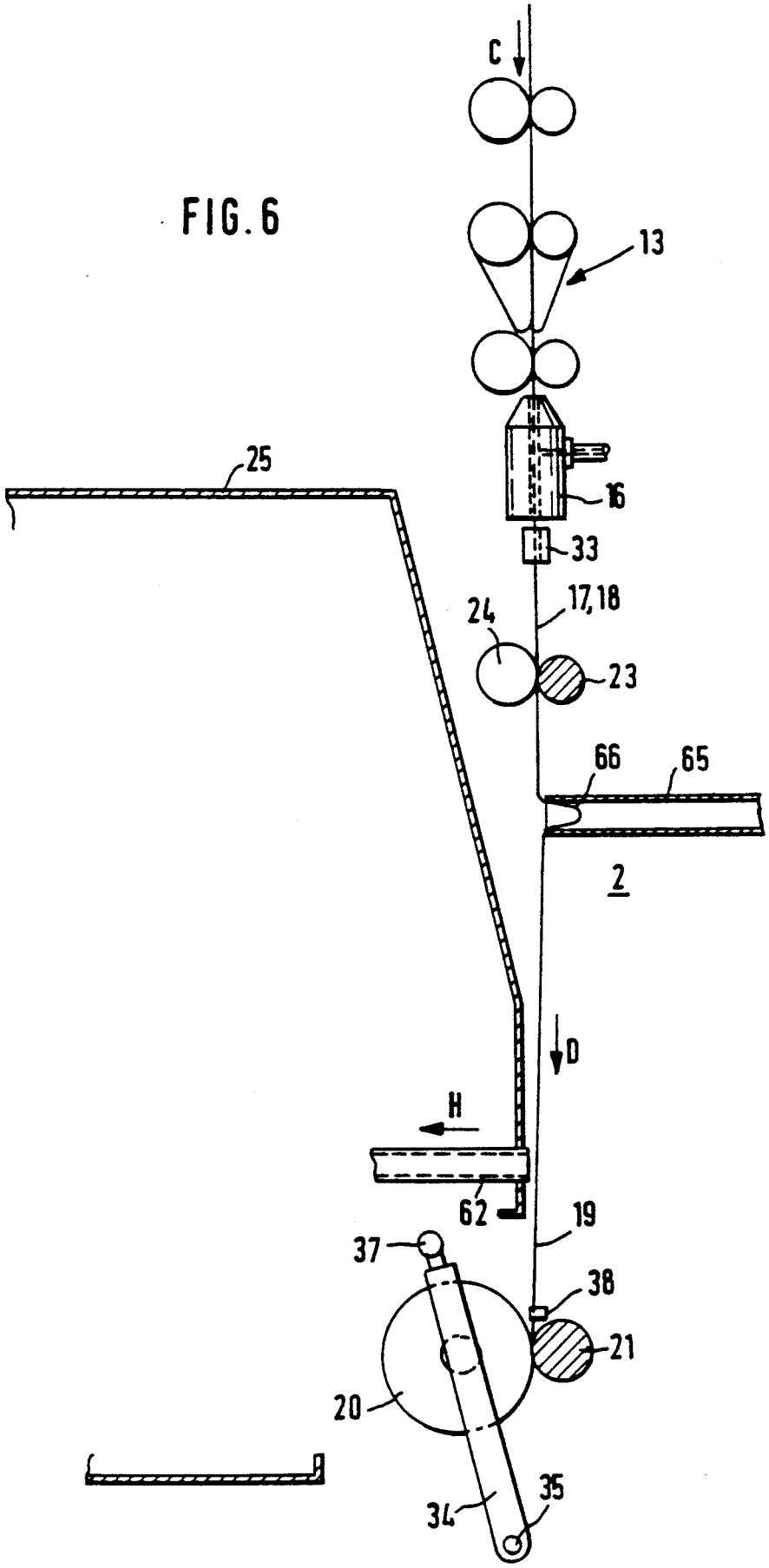
FIG. 6 is a view of a spinning unit with a stationary yarn storage device and of a schematically illustrated arrangement for the elimination of a yarn breakage.

As indicated in FIG. 6, it is not necessary to completely open up the excess yarn length resulting from the deflection to the arrangement 25 before the wound-up package 20 is returned to the winding shaft 21 of the spinning machine. This will not be necessary if a suction tube 65 is arranged in the yarn travel path of the spinning unit which receives the double yarn 19 in a defined manner in the form of a loop 66 and holds it tensioned in such a manner that it can, in particular, also not leave the cross-winding yarn guide 38. In this case, the transfer of the wound-up package 20 to the winding shaft 21 can take place before the loop 64 of the auxiliary yarn storage device 62 (yarn guide) has been opened up completely.

When such a suction tube 65 does not exist, it is expedient, however, to not carry out the transfer of the wound-up package 20 to the winding shaft 21 of the spinning machine 12 before the loop 64 has been opened up. This is determined by way of a sensor 67 in the end area of the yarn guide 62 constructed as the suction tube and is reported to the control device 61 which will then correspondingly trigger the transfer of the wound-up package 20.

Figure 7:
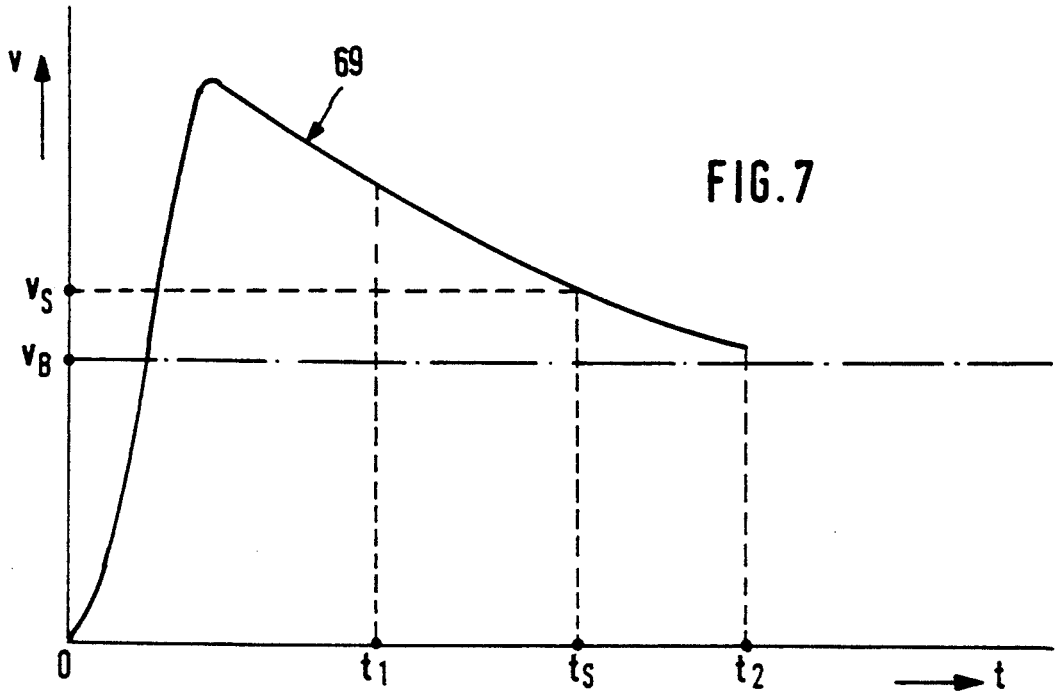
FIG. 7 is diagram which illustrates the winding speed of an auxiliary winding device of the arrangement of eliminating a yarn breakage above the time after the conclusion of the splicing operation.

As mentioned above, the speed of the driving motor 46 of the auxiliary winding roller 43 is controlled according to a given program so that a given course is obtained of the winding speed of the auxiliary winding roller 43. A first example of this course is shown in FIG. 7 by means of curve 69 which represents the course of the winding speed (V) of the auxiliary winding roller 43 above the time (t) which starts with the point in time (0), that is, the point in time of the conclusion of the establishment of the spliced connection. In order to empty the yarn storage device 56 as fast as possible, the auxiliary winding roller 43 is accelerated very fast to a high winding speed (V) which preferably corresponds to twice the operational winding speed ($V_B$) of the spinning unit. Subsequently, the winding speed is reduced again corresponding to the curve 69, in which case, however, the drop of the speed is clearly slower than the rise. In practice, it cannot be expected that the wound-up package 20 follows exactly the rise of the curve 69 during the acceleration. Because of the unavoidable slippage which, among other things, is a function of the respective package diameter, the wound-up package itself is accelerated more slowly, that is, it will at first lag behind with respect to the curve 69. It may be assumed, however, that after a certain time period, the slippage was eliminated so that then the wound-up package 20, particularly along the descending area of the curve 69, will precisely follow the course of the curve 69. The curve 69 is designed in such a manner that an emptying of the yarn storage device 56 will have taken place before the winding speed (v) of the auxiliary winding roller 43 according to curve 69 has fallen again to the operational winding speed ($V_B$) of the spinning unit. When, for example, at the point in time ($t_s$), the sensors emit the signal that the yarn storage device 56 has been emptied, the auxiliary winding roller 43 has a winding speed ($V_s$). This winding speed is tapped at the driving motor 46, for example, by a generator and is reported to the control device 61. On the basis of this information, the control device 61 knows at which point of the control program for the winding speed (v) of the auxiliary winding roller 43 it is situated at that particular time. An empirically determined time period ($t_s$–$t_2$) is assigned to this point of the control program which is required for the complete using-up of the yarn deflection—the so-called "yarn knee"—(or for a defined partial using-up). At the point in time ($t_s$), the control device 61 selects this time period ($t_s$–$t_2$) and starts it with the point in time ($t_s$) After the expiration of this time period, the winding speed (v) is reduced to the operational winding speed ($V_B$).

In order to achieve that by the end of the time period ($t_s$–$t_2$), there is no excessive speed difference with respect to the operational winding speed ($V_B$), the curve 69 is designed such that, in the case of a slippage-free drive of the wound-up roller 20 by auxiliary winding roller 43, the yarn storage device is not emptied before the winding speed (V) is clearly reduced in comparison to the maximum. Care is therefore taken that the signal of the sensors 59 cannot occur before a point in time ($t_s$) which is after the point in time ($t_1$) at which the winding speed (v) has clearly been reduced again.

Figure 8:
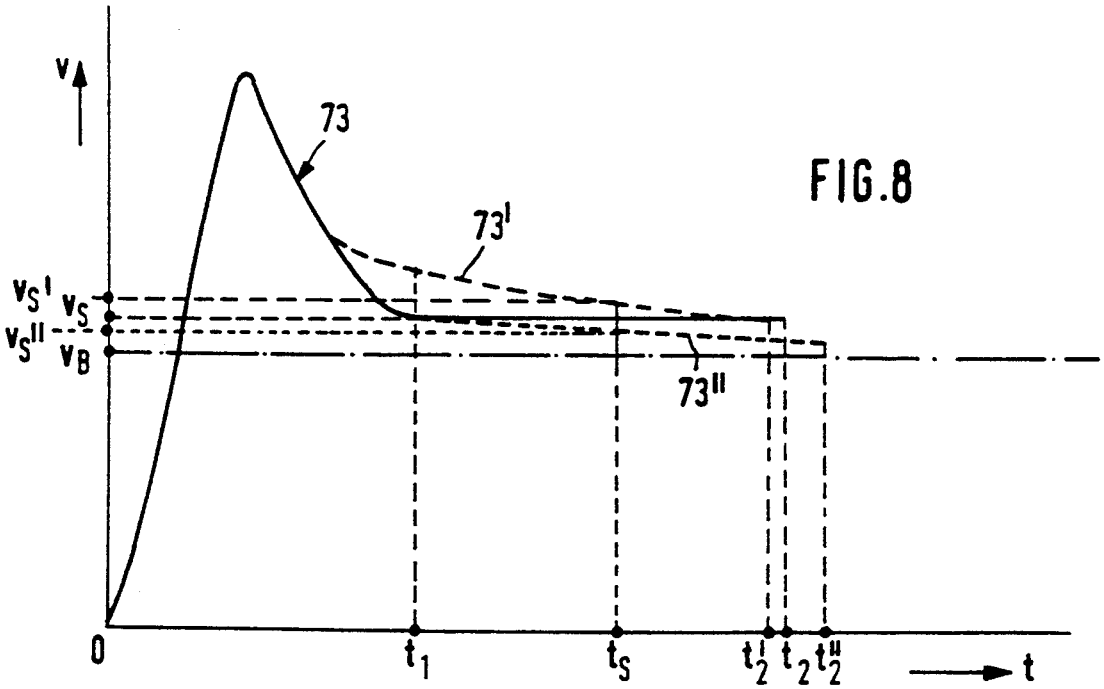
FIG. 8 is a diagram similar to FIG. 7 with a modified course of the winding speed of the arrangement for eliminating a yarn breakage.

In order to achieve that, in the case of each elimination of a yarn breakage, the same time period ($t_s$–$t_2$) can be used which had been determined empirically, by means of the control program, a course of the winding speed (v) of the auxiliary winding roller 43 is provided according to curve 73 of FIG. 8. Here also, the auxiliary winding roller 43 is first accelerated rapidly with a steep slope to the maximum winding speed (v) which also amounts to approximately twice the operational winding speed ($V_B$). However, then a relatively fast deceleration takes place to a constant value ($V_s$). The control program is designed such that, even in the case of a slippage-free drive of the wound-up package 20 by means of the auxiliary winding roller 43, the yarn storage device 5 will not be emptied before the winding speed (v) has been reduced to the constant winding speed ($V_s$) which is, for example 10 to 20 percent above the operational winding speed ($V_B$). The signal of the sensors 59 can occur only at a point in time ($t_s$) which is after the point in time ($t_1$), that is, during a winding speed (v) which is reduced to a constant value ($v_s$). For the opening-up of the "yarn knee", the same time period ($t_s$–$t_2$) will then be required in each case so that it has to be determined only once and can then always be retained in the same manner.

As arranged in FIG. 8 by means of the curves 73' and 73'', it may be permissible under certain circumstances to not keep the winding speed (v) constant after the point in time ($t_s$) but possibly permit also in this area a continuous slight reduction. The occurring errors are relatively low so that then for curve 73' always the same time period ($t_s$–$t'_2$) or for the curve 73'', the same time period ($t_s$–$t''_2$) can be maintained which had been determined empirically. The occurring error is not excessively large and can be absorbed by the yarns without resulting in a yarn defect.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine including;

a plurality of spinning units arranged in at least one row next to each other, each spinning unit comprising spinning apparatus for spinning a yarn and winding up apparatus for winding the yarn onto a package at a normal spinning operation winding speed, and a mobile yarn breakage repairing carriage which can be applied to the individual spinning units, said carriage comprising:

temporary yarn storage apparatus for temporarily storing newly spun yarn, broken yarn withdrawal apparatus for withdrawing broken yarn from the package, connecting apparatus for connecting the newly spun yarn and the yarn withdrawn from the package, winding apparatus for winding the connected yarn onto the package, said winding apparatus including a package drive which is driveable at an increased speed for winding up yarn accumulated in the temporary storage apparatus, package return apparatus for returning the package and running yarn to the respective spinning unit, package drive apparatus for controlling the speed of the package drive, and yarn sensor apparatus for sensing the yarn stored in the temporary yarn storage apparatus to thereby determine a point in time $t_s$ corresponding to the emptying of the temporary yarn storage apparatus and for generating a corresponding temporary yarn storage empty signal, wherein the package drive control apparatus includes a control program for controlling the package drive after establishment of a yarn connection by the connecting apparatus to operate sequentially:

(i) to first accelerate the package drive to a first high winding speed substantially above the normal spinning operation winding speed;

(ii) to subsequently reduce the package drive to a second high winding speed lower than the first high winding speed and still higher than the normal spinning operation winding speed until time $t_s$ when the yarn sensor apparatus senses emptying of the temporary yarn storage apparatus and generates a temporary yarn storage empty signal; and (iii) to subsequently operate the package drive for a predetermined period of time $t_s$–$t_2$ after time $t_2$ at a predetermined third high winding speed which is lower than the second high winding speed and still higher than the normal spinning operation winding speed;

and wherein the package return apparatus includes package return control apparatus for returning the package and running yarn to the respective spinning unit after said predetermined period of time $t_s$–$t_2$.

2. A spinning machine according to claim 1, wherein the first high winding speed is approximately twice the normal spinning operation winding speed.

3. A spinning machine according to claim 2, wherein the second high winding speed is an approximate constant value speed.

4. A spinning machine according to claim 2, wherein the package return apparatus includes an auxiliary yarn storage device controllable by the control apparatus during emptying of the temporary yarn storage apparatus.

5. A spinning machine according to claim 4, wherein the auxiliary yarn storage device is constructed as a suction element piece which has a width transversely to the travelling direction of the yarn which corresponds approximately to the width of the package.

6. A spinning machine according to claim 4, wherein the auxiliary yarn storage device is constructed as a suction element piece which has a width transversely to the travelling direction of the yarn which corresponds approximately to the width of the package.

7. A spinning machine according to claim 3, wherein the package return apparatus includes an auxiliary yarn storage device controllable by the control apparatus during emptying of the temporary yarn storage apparatus.

8. A spinning machine according to claim 7, further comprising a suction tube at each spinning unit in the yarn travel path upstream of the temporary yarn storage apparatus of the carriage, said suction tube being configured and operated to receive the yarn in a defined manner in the form of a loop and hold it tensioned in a defined manner in such a form that the transfer of the package drive back to the spinning unit away from the yarn repairing carriage can take place before complete removal of a yarn loop in the auxiliary yarn storage device of the carriage.

9. A spinning machine according to claim 8, wherein the auxiliary yarn storage device is constructed as a suction element piece which has a width transversely to the travelling direction of the yarn which corresponds approximately to the width of the package.

10. A spinning machine according to claim 1, wherein the second high winding speed is an approximate constant value speed.

11. A spinning machine according to claim 10, wherein the package return apparatus includes an auxiliary yarn storage device controllable by the control apparatus during emptying of the temporary yarn storage apparatus.

12. A spinning machine according to claim 1, wherein the package return apparatus includes an auxiliary yarn storage device controllable by the control apparatus during emptying of the temporary yarn storage apparatus.

13. A spinning machine according to claim 12, wherein the auxiliary yarn storage device is constructed as a suction element piece which has a width transversely to the travelling direction of the yarn which corresponds approximately to the width of the package.

14. A spinning machine according to claim 12, wherein the auxiliary yarn storage device is constructed as a suction element piece which has a width transversely to the travelling direction of the yarn which corresponds approximately to the width of the package.

15. A spinning machine according to claim 12, further comprising a suction tube at each spinning unit in the yarn travel path upstream of the temporary yarn storage apparatus of the carriage, said suction tube being configured and operated to receive the yarn in a defined manner in the form of a loop and hold it tensioned in a defined manner in such a form that the transfer of the package drive back to the spinning unit away from the yarn repairing carriage can take place before complete removal of a yarn loop in the auxiliary yarn storage device of the carriage.

16. A spinning machine according to claim 15, wherein the auxiliary yarn storage device is constructed as a suction element piece which has a width transversely to the travelling direction of the yarn which corresponds approximately to the width of the package.

17. A method of operating a spinning machine of the type including:

a plurality of spinning units arranged in at least one row next to each other, each spinning unit comprising spinning apparatus for spinning a yarn and winding up apparatus for winding the yarn onto a package at a normal spinning operation winding speed, and a mobile yarn breakage repairing carriage which can be applied to the individual spinning units, said carriage comprising:

temporary yarn storage apparatus for temporarily storing newly spun yearn, broken yarn withdrawal apparatus for withdrawing broken yarn from the package, connecting apparatus for connecting the newly spun yarn and the yarn withdrawn from the package, winding apparatus for winding the connected yarn onto the package, said winding apparatus including a package drive which is driveable at an increased speed for winding up yarn accumulated in the temporary storage apparatus, package return apparatus for returning the package and running yarn to the respective spinning unit, package drive apparatus for controlling the speed of the package drive, and yarn sensor apparatus for sensing the yarn stored in the temporary yarn storage apparatus to thereby determine a point in time $t_s$ corresponding to the emptying of the temporary yarn storage apparatus and for generating a corresponding temporary yarn storage empty signal, said method including the sequential steps of:

(i) establishing a yarn connection with the connecting apparatus, (ii) first accelerating the package drive to a first high winding speed substantially above the normal spinning operation winding speed;

(iii) subsequently reducing the package drive to a second high winding speed lower than the first high winding speed and still higher than the normal spinning operation winding speed until time $t_s$ when the yarn sensor apparatus senses emptying of the temporary yarn storage apparatus and generates a temporary yarn storage empty signal; and (iv) subsequently operating the package drive for a predetermined period of time $t_s$–$t_2$ after time $t_s$ at a predetermined third high winding speed which is lower than the second high winding speed and still higher than the normal spinning operation winding speed; and (v) returning the package and running yarn to the respective spinning unit after said predetermined period of time $t_s$–$t_2$.

18. A method according to claim 17, wherein the first high winding speed is approximately twice the normal spinning operation winding speed.

19. A method according to claim 18, wherein the second high winding speed is an approximate constant value speed.

20. A method according to claim 18, wherein returning the package includes using an auxiliary yarn storage device controllable by the control apparatus during emptying of the temporary yarn storage apparatus.

21. A method according to claim 20, wherein the auxiliary yarn storage device is constructed as a suction element piece which has a width transversely to the travelling direction of the yarn which corresponds approximately to the width of the package.

22. A method according to claim 20, further comprising using a suction tube at each spinning unit in the yarn travel path upstream of the temporary yarn storage apparatus of the carriage for receiving the yarn in a defined manner in the form of a loop and hold it tensioned in a defined manner in such a form that the transfer of the package drive back to the spinning unit away from the yarn repairing carriage can take place before complete removal of a yarn loop in the auxiliary yarn storage device of the carriage.

23. A method according to claim 17, wherein the second high winding speed is an approximate constant value speed.

24. A method according to claim 17, wherein returning the package includes using an auxiliary yarn storage device controllable by the control apparatus during emptying of the temporary yarn storage apparatus.

25. A method according to claim 24, wherein the auxiliary yarn storage device is constructed as a suction element piece which has a width transversely to the travelling direction of the yarn which corresponds approximately to the width of the package.

26. A method according to claim 24, further comprising using a suction tube at each spinning unit in the yarn travel path upstream of the temporary yarn storage apparatus of the carriage for receiving the yarn in a defined manner in the form of a loop and hold it tensioned in a defined manner in such a form that the transfer of the package drive back to the spinning unit away from the yarn repairing carriage can take place before complete removal of a yarn loop in the auxiliary yarn storage device of the carriage.

* * * * *